United States Patent [19]

Shiroyama

[11] Patent Number: 4,480,528

[45] Date of Patent: Nov. 6, 1984

[54] TRIGGER VALVE FOR PNEUMATIC NAILING MACHINE

[76] Inventor: Tadayoshi Shiroyama, 4150 Midorigaoko, Honmachi Uenoshi, Mieken, Uenokojo, Japan

[21] Appl. No.: 515,691

[22] Filed: Jul. 21, 1983

[30] Foreign Application Priority Data

Oct. 26, 1982 [JP] Japan ..... 57/187927

[51] Int. Cl.[3] ..... F15B 13/042

[52] U.S. Cl. ..... 91/461; 91/399; 91/DIG. 3; 227/130

[58] Field of Search ..... 91/399, 461, DIG. 3, 91/308; 227/130

[56] References Cited

U.S. PATENT DOCUMENTS

| | | | |
|---|---|---|---|
| 3,106,134 | 10/1963 | Osborne | 91/461 |
| 3,170,487 | 2/1965 | Juilfs et al. | 91/461 |
| 3,313,213 | 4/1967 | Wandel | 91/399 |
| 3,527,142 | 9/1970 | Obergfell | 91/461 |
| 3,552,270 | 1/1971 | Lange | 91/461 |

*Primary Examiner*—Paul E. Maslousky

*Attorney, Agent, or Firm*—Lucas & Just

[57] ABSTRACT

An improved trigger valve for a pneumatic nailing machine is disclosed. A communication hole between the main air chamber and the pilot air chamber is made as small as possible. This allows the trigger valve to return in a delayed manner so that the head valve and driver piston operate properly.

1 Claim, 5 Drawing Figures

B
15
11
13
26
17
12
A
14
33
41
24
40
40a
C
18
35
38
36
42
43
39
37

TRIGGER VALVE FOR PNEUMATIC NAILING MACHINE

Background of the Invention

The present invention relates to an improved trigger valve used in a pneumatic pressure type of nailing machine. In a known pneumatic nailing machine illustrated in FIG. 5, a trigger valve A is incorporated between a main air chamber 1 in the body of the nailing machine and an air passage 2 which communicates with a chamber above a head valve. The trigger valve A consists of a trigger valve cylinder 3, a trigger pilot valve stem 4, and a trigger valve stem 5. An exhaust passage 6 and a communication hole 7 are provided at separate positions in the trigger valve cylinder 3, the communication hole 7 being connected to the air passage 2. A pilot air chamber 8 is formed beneath the trigger pilot valve stem 4 in the trigger valve cylinder 1.

When the pilot air chamber 8 is shut off from the exhaust passage 6 but is connected to the main air chamber 1 so that it is supplied with the operating air, the trigger pilot valve stem 5 is pushed up to top dead center, the air passage 2 is shut off from the exhaust passage 6, and the operating air is contained in the chamber above the head valve piston. When the pilot air chamber 8 is shut off from the main air chamber 1 and is opened to the outside, the operating air is allowed to escape into the atmosphere, whereby the trigger pilot valve stem 4 is pushed down to bottom dead center, the air passage 2 communicates with the exhaust passage 6, and the operating air in the chamber above the head valve piston is allowed to escape into the atmosphere.

If a trigger lever 10 is pulled upward when the lower end of a contact arm 9 is placed on the surface to be nailed, the trigger valve stem 5 is pushed up, and the trigger valve A operates. However, when the contact arm 9 is pressed onto the surface being nailed, and the trigger lever 10 is pulled upward to perform the nailing operation, the contact arm 9 moves up and down through a short distance to develop the so-called dribble motion due to the reaction of the driver. When the dribble motion is taking place, the contact arm 9 moves upwards through a small distance. Accordingly, the trigger valve stem 5 also moves upwards a small distance, and the trigger valve A operates for a reduced period of time. With the operating time of the trigger valve A reduced, the time during which the head valve is open is also reduced. That is, the head valve closes before it has opened completely.

Thus, if the nailer driver is pushed down with the head valve allowed to open only for a reduced period of time, the compressed air for returning the driver piston can not be completely charged into an air reservoir chamber through a small hole formed in the side wall of the cylinder. Therefore, the piston is returned by a reduced air pressure, or the piston is not completely pushed up, and the nailing operation becomes unstable.

According to the present invention, therefore, a communication hole communicating the main air chamber with the pilot air chamber is made as small as possible, so that the trigger valve is allowed to return in a delayed manner. Namely, the head valve and the driver piston are allowed to operate properly, and dribble motion and abnormal operation are prevented from occurring.

Summary of the Invention

The object of the present invention is to eliminate the defect that the head valve closes before it is opened completely which results from the fact that the trigger valve is able to operate for only a very short period of time when the trigger is pulled quickly and continuously, or when a contact lever communicating with a contact arm is moved rapidly, as well as eliminate the defect that the operating air is not supplied sufficiently into the air reservoir chamber, caused by the incomplete motion of the head valve.

To accomplish the above object, a hole communicating the pilot air chamber with the main air chamber is made as small as possible to supply operating air at a reduced rate into the pilot air chamber. Therefore, a predetermined restoration time is required before the trigger valve returns perfectly to its initial position after it is released from its pulled position. Thus, the trigger valve enables the head valve and the driver piston to obtain time to perform their operations completely.

Detailed Description of the Invention

Figure 2:
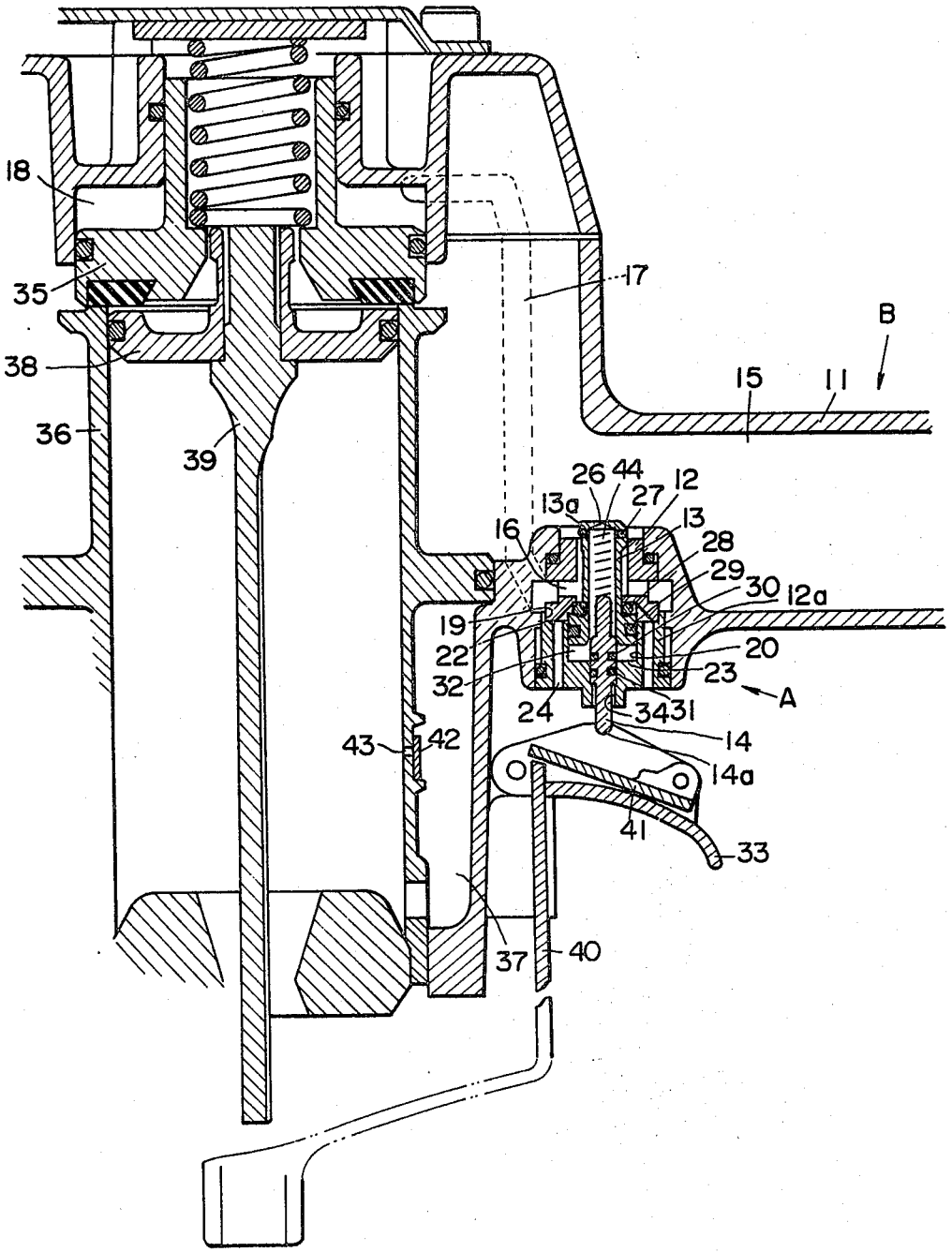
FIG. 2 is a section of the major parts of the pneumatic nailing machine when the trigger is not pulled.
Figure 3:
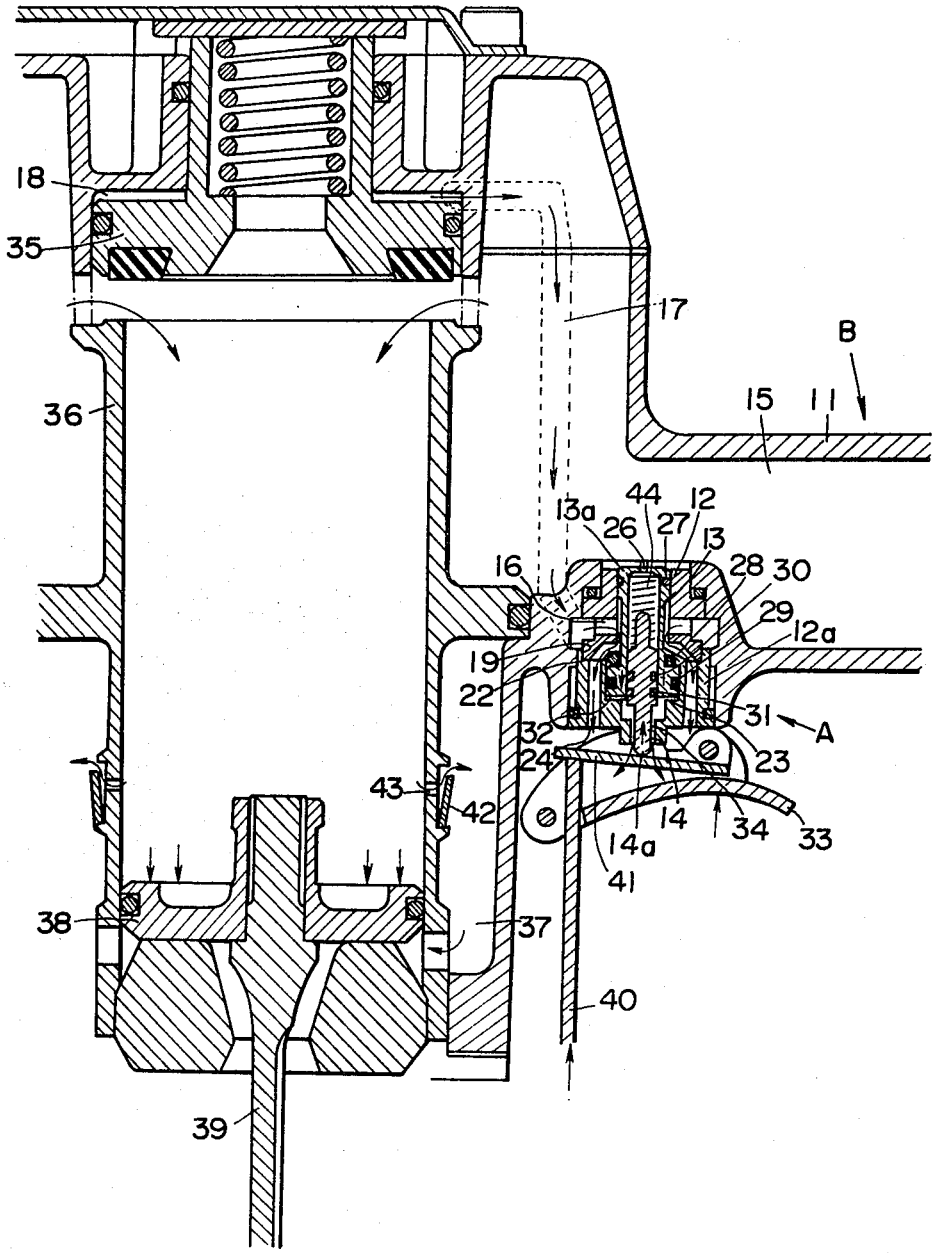
FIG. 3 is a section of the major parts of the pneumatic nailing machine when the trigger is pulled.
Figure 4:
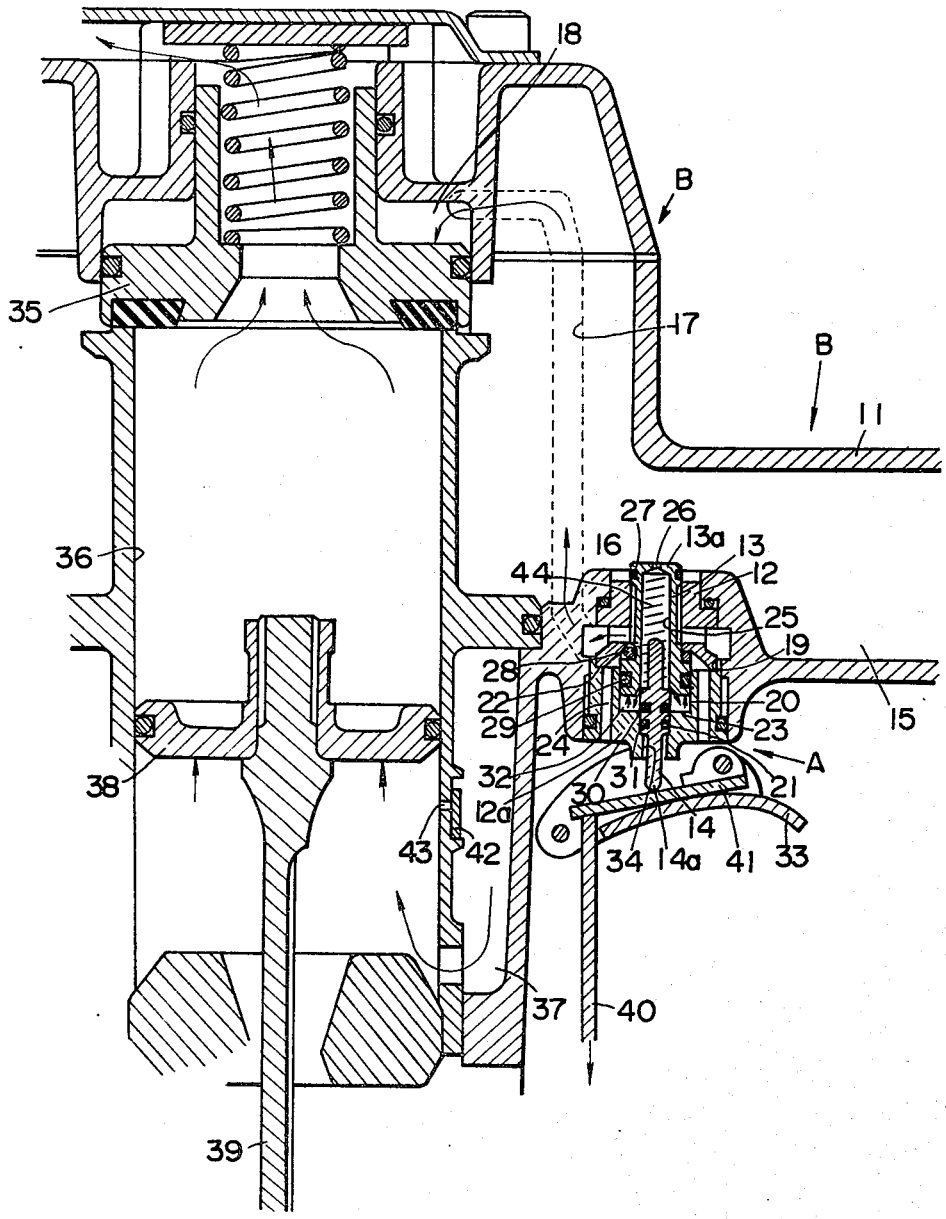
FIG. 4 is a section of the major parts of the pneumatic nailing machine when the contact arm or trigger lever is returned to its initial state.
Figure 5:
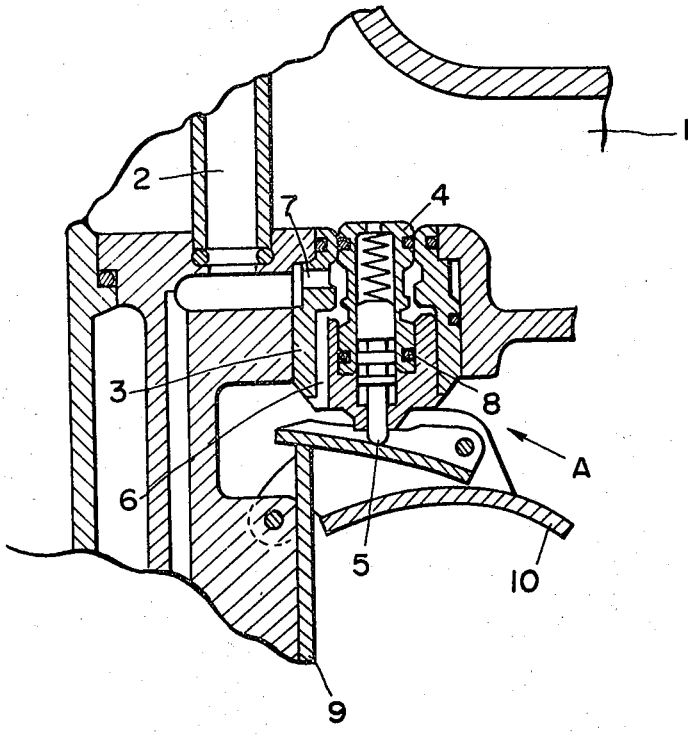
FIG. 5 is a large-scale section of an existing trigger valve employed in a pneumatic nailing machine.

A preferred embodiment of the invention will be described below in detail in conjunction with FIGS. 1 to 3.

Figure 1:
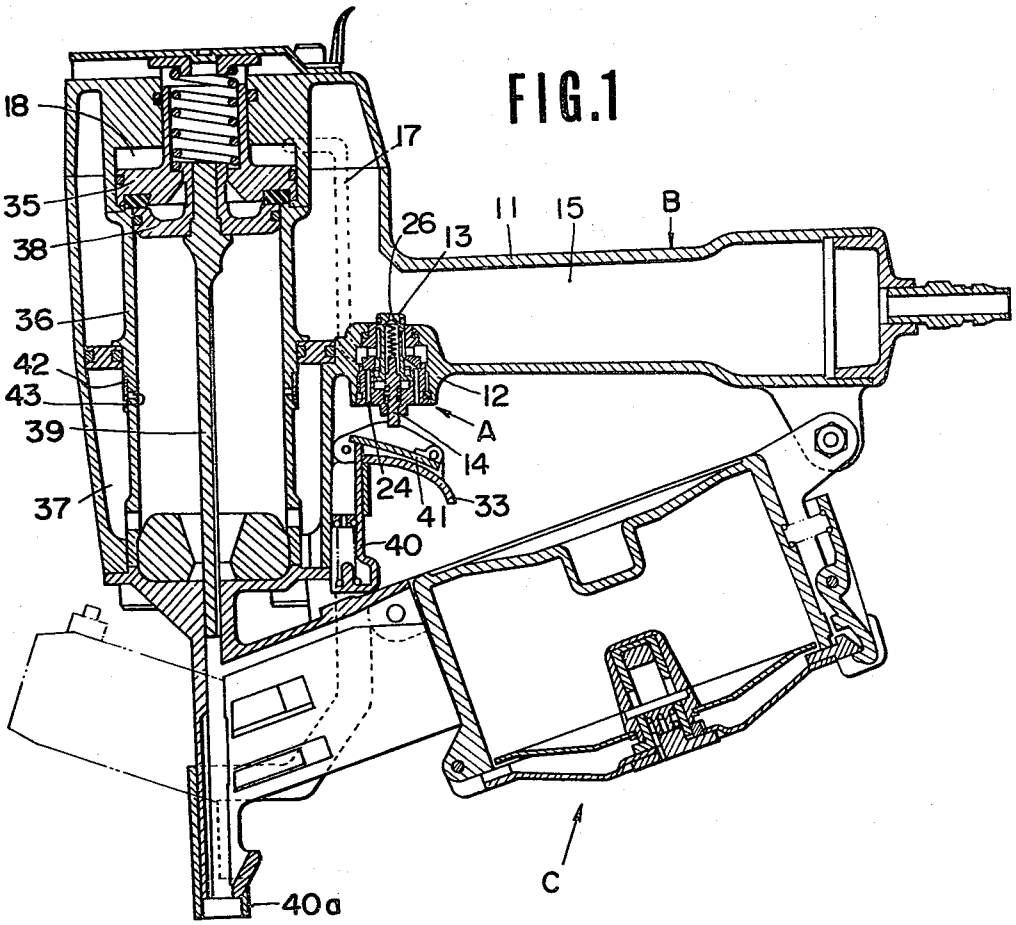
FIG. 1 is a section of a complete pneumatic nailing machine.

In FIG. 1, a trigger valve A is provided in front of a grip portion 11 of a nailing machine body B. The trigger valve A consists of a trigger valve cylinder 12, a trigger pilot valve stem 13, and a trigger valve stem 14.

The trigger valve cylinder 12 consists of two parts 12, 12*a* that divide it into an upper part and a lower part formed vertically with its upper and lower surfaces closely joined together at approximately the middle position in the lengthwise direction of the cylinder. The upper end surface of the upper trigger valve cylinder 12 is open and communicates with a main air chamber 15 in the body B of the nailing machine. A lateral hole 16 is formed in a portion of the outer wall of the upper trigger valve cylinder, it communicates with an air passage 17 which communicates with a chamber 18 above the head valve. A large-diameter hole 19, an intermediate-diameter hole 20, and a small-diameter hole 21 are formed within the lower trigger valve cylinder 12*a* in a stepped manner from the upper side toward the lower side thereof. The lower end of the small-diameter hole 21 opens onto the lower side of the grip portion 11 on the trigger side. Shoulder portions 22, 23 are formed between the ends of the holes of different diameters. The lower end of the upper trigger valve cylinder 12*a* fits into the large-diameter hole 19 in the lower trigger valve cylinder 12*a*, and is received by the shoulder portion 22, so as to form a trigger valve cylinder. A through-hole is formed in the side of the shoulder portion 22 which is further in than the inner diameter of the trigger valve cylinder, the throughhole extending downward in the axial direction so as to open to the outside, thereby forming an exhaust passage 24 which communicates with the air passage 17 via lateral hole 16.

The trigger pilot valve stem 13 is formed in a cylindrical shape and contains a hollow portion 25 which extends from the lower end to the inner side of an upper closed surface 13*a* thereof. A communication hole 26 is formed at the center of the upper closed surface 13*a*, the communication hole 26 having a diameter as small as possible. The main air chamber 15 communicates with a pilot air chamber 20 that will be described later via the small-diameter communication hole 26. The diameter of the communication hole 26 should, preferably, be less than 0.5 mm. The trigger pilot valve stem 13 has a first O-ring 27 on the upper circumferential portion thereof, and second and third O-rings 28, 29 on the lower circumferential portion thereof which has a larger diameter. The upper portion of the trigger pilot valve stem 13 fits slidably into the upper trigger valve cylinder 12, and the lower portion of the trigger pilot valve stem 13 fits slidably into a pilot air chamber defined by the intermediate-diameter hole 20 formed in the lower trigger valve cylinder 12*a*, so as to move vertically.

When the trigger pilot valve stem 13 is located at top dead center relative to the trigger valve cylinders 12, 12*a*, the second O-ring 28 engages closely with the lower surface of the upper trigger valve cylinder 12 to shut off the communication between the lateral hole 16 and the exhaust passage 24. In this case, however, the main air chamber 15 communicates with the lateral hole 16 via a gap formed around the outer side of the first O-ring 27, and compressed air is supplied from the air passage 17 to the chamber 18 above the head valve.

When the trigger pilot valve stem 13 is located at bottom dead center relative to the trigger valve cylinders 12, 12*a*, the first O-ring 27 is in close contact with the inner circumference of the upper trigger valve cylinder to shut off the communication between the main air chamber 11 and the lateral hole 16. The third O-ring 29 slides down in the pilot air chamber. Hence, the second O-ring 28 moves downward so as to separate away from the lower surface of the upper trigger valve cylinder 12, and the lateral hole 16 communicates with the exhaust passage 24, and the air in the chamber 18 above the head valve is allowed to escape to the atmosphere through the exhaust passage 24.

The trigger valve stem 14 is formed in the shape of a rod, and has fourth and fifth O-ring 30, 31 fitted around an intermediate portion thereof. The O-rings 30, 31 of the trigger valve stem 14 fits slidably fitted into a valve chamber 32 defined by the small-diameter hole 20 in the lower trigger valve cylinder 12*a* and into a hollow portion 25 in the trigger pilot valve stem 13. The stem 13 is supported at an upper position by a coil spring 44 which fits into the hollow portion 25. The stem 13 also has a stem operating end 14*a* which protrudes outward toward the trigger side so as to be pushed by the trigger.

When the trigger lever 33 is pulled and the trigger valve stem 14 rises, the fourth and fifth O-rings 30, 31 slide into the hollow portion 25 in the trigger pilot valve stem 13, so that no air is allowed to flow through the small-diameter communication hole 26. Therefore, the trigger pilot valve stem 13 is located at bottom dead center, and the operating air in the pilot air chamber 32 is allowed to escape into the atmosphere through a gap between the stem operating end 14*a* and an opening 34.

When the trigger lever 33 is released and the trigger valve stem 14 is able to move down, the fifth O-ring 31 separates from the trigger pilot valve stem 13 and slides into the valve chamber to shut off the path to the opening 34. Thereafter, the fourth O-ring 30 separates from the hollow portion 25 so that the air passage through the communication hole 26 is opened. Therefore the operating air is supplied to the pilot air chamber 32 to move the trigger pilot valve stem 13 upwards.

Since the communication hole 26 has a very small diameter, the operating air is supplied at a small rate from the main air chamber 15 into the pilot air chamber 32 to delay the return motion of the trigger pilot valve stem 13 more than in the conventional nailing machine. As mentioned above, a predetermined period of time is required for the trigger pilot valve stem 13 to return properly from bottom dead center to top dead center and, hence, a head valve 35 is kept open relative to a main cylinder 36 for the predetermined period of time required to perform the return motion. Accordingly, the operating air from the main air chamber 15 is allowed to flow sufficiently into an air reservoir chamber 37. When the trigger pilot valve stem 13 has completely returned to its initial position, the head valve 35 is located at bottom dead center to exhaust the air in the cylinder, and also cause a driver piston 38 to move completely to top dead center utilizing the sufficient quantity of operating air which has entered into the air reservoir chamber 37.

To operate a driver 39, the lower end 40*a* of a contact arm in the nail-driving port in the nailing machine body B is pressed onto the surface of the wall where the nail is to be driven. A contact arm 40 is then pushed up, a contact lever 41 is pushed up, and the trigger lever 33 is pulled up to supply operating air into the main cylinder 36. Even when the trigger lever 33 is being pulled, the movement of the contact arm 40 and contact lever 41 vertically causes the trigger valve A to operate. When driving a nail with the driver 39, if the body B of the nailing machine undergoes tamping when it receives nailing impacts, the contact arm 40 and contact lever 41 also undergo tamping as mentioned above, and the trigger valve A is operated immediately.

In the conventional nailing machine, if the trigger valve A moves immediately, the head valve also opens and closes immediately. Therefore, the driver 39 undergoes the dribble motion, the main cylinder 36 moves only partly, a sufficient quantity of operating air is not supplied into the air reservoir chamber 37 through a hole 43 formed in the main cylinder 36 and equipped with a check valve 42, and the air pressure is so weak that the driver piston 38 is not pushed fully upward. Therefore, even when the trigger lever 33 is pulled again, the driver 39 does not perform its operation completely.

According to the present invention as described above, the closed surface 13*a* of the trigger pilot valve stem 13 has a communication hole 26 of a diameter which is as small as possible. Therefore, the trigger valve is allowed to return in a delayed manner, and an extended period of time is reserved in which the head valve 35 and the driver piston 38 can operate. Accordingly dribble motion is eliminated, and the nailing operation is performed stably. The symbol C denotes a magazine device containing a nail coil.

What is claimed is:

1. A trigger valve for a pneumatic nailing machine comprising: a head valve which is provided in a passage between a main air chamber and a main cylinder in which a driver piston reciprocates, and which opens and closes said passage; a trigger valve which is incorporated in an air passage communicating with a chamber above said head valve and with said main air chamber, said trigger valve forming a trigger valve cylinder comprising two cylinder parts that divide it into an upper portion and a lower portion said upper and lower portions being closely joined together; a lateral hole formed in the upper cylinder part of said cylinder, which communicates with said main air chamber and with said air passage; an exhaust hole formed in the lower cylinder part, which communicates with the atmosphere on the side of the trigger lever; a cylindrical trigger pilot valve stem provided in the trigger valve cylinder, which is slidable up and down within a range bounded by top dead center and bottom dead center; first, second and third O-rings fitted onto said trigger pilot valve stem to open said lateral hole and said main air chamber when said stem is located at top dead center and to close said lateral hole and said exhaust hole when said stem is located at bottom dead center; a small-diameter communication hole formed in an upper closed surface of said trigger pilot valve stem, which communicates with a hollow portion in said stem and with said main air chamber; a pilot air chamber which is formed in said lower cylinder part and which communicates with said main air chamber via said small-diameter communication hole; a trigger valve stem provided in the lower cylinder part, which is slidable in the hollow portion formed in said trigger pilot valve stem; and fourth and fifth O-rings which are fitted onto said trigger valve stem to open and close said small-diameter communication hole and said pilot air chamber.

* * * * *